US011421566B2

(12) United States Patent
Kawaguchi et al.

(10) Patent No.: US 11,421,566 B2
(45) Date of Patent: Aug. 23, 2022

(54) WORK MACHINE, CONTROL METHOD THEREOF, AND SUPPLY SYSTEM

(71) Applicant: HONDA MOTOR CO., LTD., Tokyo (JP)

(72) Inventors: Noboru Kawaguchi, Wako (JP); Ryo Saito, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/326,900

(22) Filed: May 21, 2021

(65) Prior Publication Data

US 2021/0372304 A1 Dec. 2, 2021

(30) Foreign Application Priority Data

May 30, 2020 (JP) ..... JP2020-095140

(51) Int. Cl.
*F01M 11/06* (2006.01)
*F01M 11/12* (2006.01)

(52) U.S. Cl.
CPC ..... *F01M 11/064* (2013.01); *F01M 11/065* (2013.01); *F01M 11/12* (2013.01); *F01M 2011/068* (2013.01)

(58) Field of Classification Search
CPC .... F01M 11/064; F01M 11/065; F01M 11/12; F01M 2011/068
See application file for complete search history.

(56) References Cited

U.S. PATENT DOCUMENTS 1,989,816 A * 2/1935 Meyer ..... F01M 11/065 184/6.2

FOREIGN PATENT DOCUMENTS

JP 2016127552 A 7/2016
WO WO-2015176809 A1 * 11/2015 ..... B60K 15/03504

* cited by examiner

*Primary Examiner* — Jacob M Amick
*Assistant Examiner* — Charles J Brauch
(74) *Attorney, Agent, or Firm* — Thomas | Horstemeyer, LLP

(57) ABSTRACT

There is provided a work machine. A reserving chamber reserves lubricating oil to be supplied to an engine. A channel forming member forms a channel of the lubricating oil from the reserving chamber to the engine A press-feed unit press-feeds the lubricating oil reserved in the reserving chamber to the engine via the channel forming member. A float floats on an oil surface of the lubricating oil reserved in the reserving chamber A detection unit provided in the reserving chamber and detects the float A determination unit determines a tilt state of the reserving chamber based on a detection result of the detection unit A control unit controls the press-feed unit based on a determination result of the determination unit.

9 Claims, 10 Drawing Sheets

WORK MACHINE, CONTROL METHOD THEREOF, AND SUPPLY SYSTEM

CROSS-REFERENCE TO RELATED APPLICATION

This application claims priority to and the benefit of Japanese Patent Application No. 2020-095140 filed on May 30, 2020, the entire disclosure of which is incorporated herein by reference.

BACKGROUND OF THE INVENTION

Field of the Invention

The present invention relates to a work machine, a control method thereof, and a supply system.

Description of the Related Art

Concerning lubrication of an engine, there has been disclosed a technique of estimating the tilt of an oil surface in an oil pan based on the tilt of a vehicle and the like and controlling an oil amount to be returned to the oil pan based on the estimation value (Japanese Patent Laid-Open No. 2016-127552).

SUMMARY OF THE INVENTION

According to one embodiment of the present invention, there is provided a work machine comprising: an engine; a reserving chamber configured to reserve lubricating oil to be supplied to the engine; a channel forming member configured to form a channel of the lubricating oil from the reserving chamber to the engine; a press-feed unit configured to press-feed the lubricating oil reserved in the reserving chamber to the engine via the channel forming member; a float configured to float on an oil surface of the lubricating oil reserved in the reserving chamber; a detection unit provided in the reserving chamber and configured to detect the float; a determination unit configured to determine a tilt state of the reserving chamber based on a detection result of the detection unit; and a control unit configured to control the press-feed unit based on a determination result of the determination unit.

According to another embodiment of the present invention, there is provided a control method of a work machine including: an engine; a reserving chamber configured to reserve lubricating oil to be supplied to the engine; a channel forming member configured to form a channel of the lubricating oil from the reserving chamber to the engine; a press-feed unit configured to press-feed the lubricating oil reserved in the reserving chamber to the engine via the channel forming member; a float configured to float on an oil surface of the lubricating oil reserved in the reserving chamber; and a detection unit provided in the reserving chamber and configured to detect the float, the method comprising: determining a tilt state of the reserving chamber based on a detection result of the detection unit; and controlling the press-feed unit based on a determination result in the determining.

According to still another embodiment of the present invention, there is provided a supply system mountable in a work machine and configured to supply lubricating oil to an engine of the work machine, comprising: a reserving chamber configured to reserve lubricating oil to be supplied to the engine; a channel forming member configured to form a channel of the lubricating oil from the reserving chamber to the engine; a press-feed unit configured to press-feed the lubricating oil reserved in the reserving chamber to the engine via the channel forming member; a float configured to float on an oil surface of the lubricating oil reserved in the reserving chamber; a detection unit provided in the reserving chamber and configured to detect the float; a determination unit configured to determine a tilt state of the reserving chamber based on a detection result of the detection unit; and a control unit configured to control the press-feed unit based on a determination result of the determination unit.

DESCRIPTION OF THE EMBODIMENTS

Figure 1:
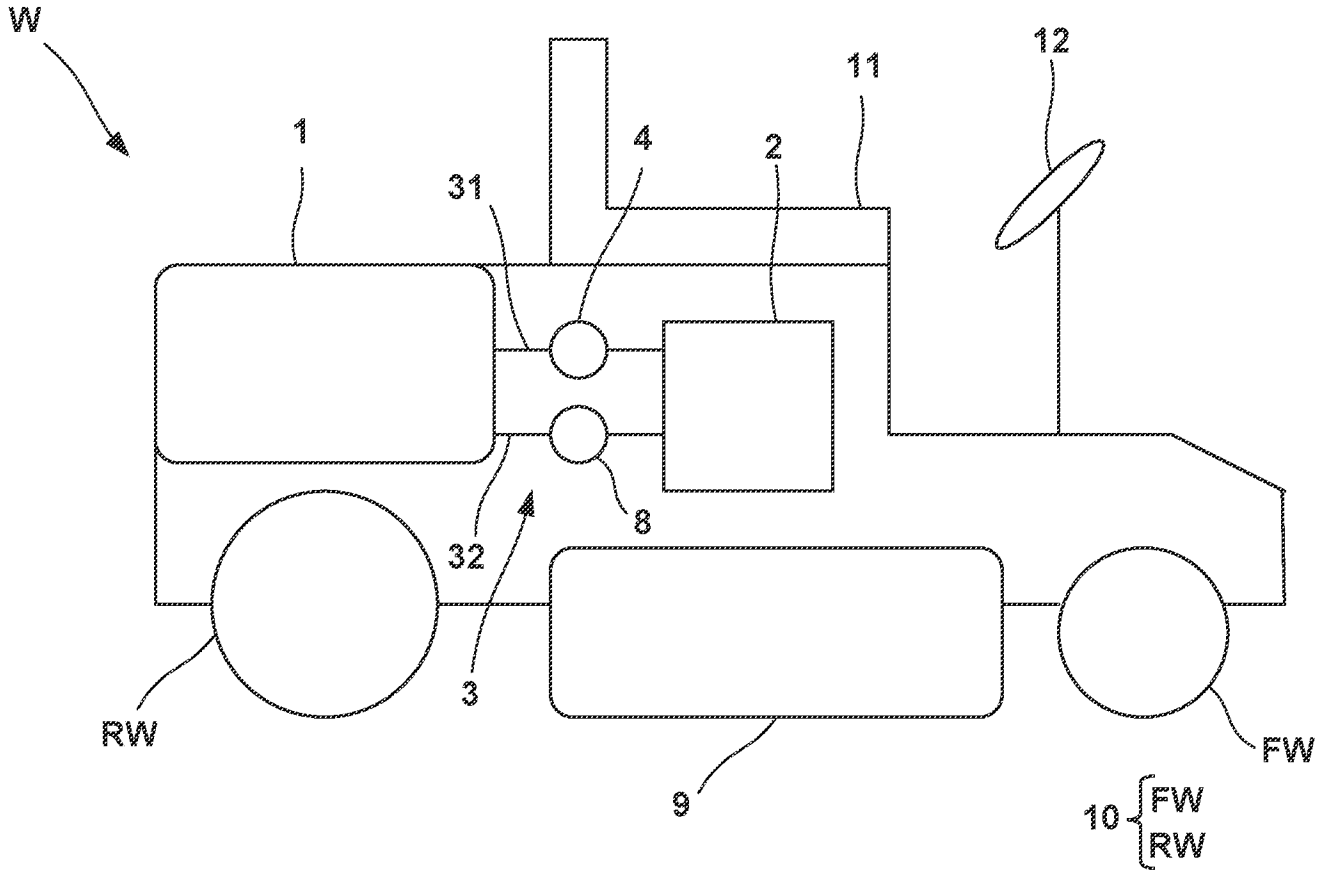
FIG. 1 is a side view schematically showing the outline of a work machine according to an embodiment.

In the above-described conventional technique, the oil amount to be returned to the oil pan is controlled using a map for estimating the tilt of the oil surface in the oil pan based on the tilt of the vehicle, a map for estimating the tilt of the oil surface in the oil pan based on the acceleration of the vehicle, and the like. However, if the engine has a variety of use modes, like a so-called general-purpose engine, it may be difficult to create an estimation map corresponding to each use mode.

An embodiment of the present invention provides a technique of appropriately maintaining an oil amount to be supplied to an engine independently of the use mode of the engine.

Hereinafter, embodiments will be described in detail with reference to the attached drawings. Note, the following embodiments are not intended to limit the scope of the claimed invention, and limitation is not made to an invention that requires a combination of all features described in the embodiments. Two or more of the multiple features described in the embodiments may be combined as appropriate. Furthermore, the same reference numerals are given to the same or similar configurations, and redundant description thereof is omitted.

First Embodiment

<Outline of Work Machine>

FIG. 1 is a side view schematically showing the outline of a work machine W according to an embodiment. The work machine W according to this embodiment is a riding type lawn mower. The work machine W includes an engine 1, a reserving chamber 2, a channel forming member 3, a supply pump 4, a discharge pump 8, a work unit 9, a travel unit 10, a seat 11, an operation unit 12, and a control unit 13 (see FIG. 3). Note that in this embodiment, a description will be made using an example in which the work machine W is a riding type lawn mower. However, the work machine W may be a work machine of another type such as a snow remover, a cultivator, or a transportation carriage. In addition, the work machine W is not limited to a riding type and may be a walking type work machine or a work machine capable of remote control or autonomous traveling.

The engine 1 is the driving source of the work machine W. In this embodiment, the engine 1 functions as the driving source of the travel unit 10 and the work unit 9. Note that the work machine W may be a hybrid vehicle including an electric motor as a driving source in addition to the engine 1. Also, if the work machine W includes an electric motor, the engine 1 may drive a power generator, and the electric motor may drive the travel unit 10 or the work unit 9 based on power generated by the power generator.

The engine 1 is a wet sump type engine that incorporates an oil pump (not shown) and circulates lubricating oil (engine oil) in the engine 1 by the oil pump. More specifically, the engine 1 sucks lubricating oil reserved in an oil pan provided in the lower part of the engine 1 by the oil pump and supplies the lubricating oil to constituent components such as a cylinder head, a crankshaft, and a camshaft (none are shown) in the engine 1.

The reserving chamber 2 reserves the lubricating oil to be supplied to the engine 1. In this embodiment, the reserving chamber 2 is provided outside the engine 1 separately from the engine 1. The reserving chamber 2 is connected to the engine 1 via the channel forming member 3. That is, the lubricating oil can move between the engine 1 and the reserving chamber 2 via a channel formed by the channel forming member 3. Also, in this embodiment, the reserving chamber 2 is provided under the seat 11 between a front wheel FW and a rear wheel RW in the front-and-rear direction. Note that the internal configuration of the reserving chamber 2 will be described later.

The reserving chamber 2 may be an oil cartridge detachably attached to the work machine W. For example, when exchanging the lubricating oil (engine oil) in the engine 1, the lubricating oil in the engine 1 is discharged to the oil cartridge using the discharge pump 8. Then, the oil cartridge is detached, the oil cartridge refilled with new lubricating oil is attached, and the lubricating oil is supplied into the engine 1 by the supply pump 4, thereby easily exchanging the lubricating oil in the engine 1.

When the oil cartridge is employed as the reserving chamber 2, an oil filter may be provided in the oil cartridge. In this case, a hydraulic line may be extended from the filter attachment portion of the engine 1, independently of the channel formed by the channel forming member 3, and connected to the oil filter in the oil cartridge. When the oil filter is incorporated in the oil cartridge, the oil filter can also be exchanged at the same time as the exchange of the lubricating oil.

The channel forming member 3 forms the channel of lubricating oil from the reserving chamber 2 to the engine 1. In this embodiment, the channel forming member 3 includes a supply channel forming member 31 that forms a channel configured to supply the lubricating oil reserved in the reserving chamber 2 to the engine 1, and a discharge channel forming member 32 that forms a channel configured to discharge the lubricating oil in the engine 1 to the reserving chamber 2. The channel forming member 3 can be constituted by, for example, a hydraulic hose formed by a flexible member, a pipe made of a metal, or the like.

The supply pump 4 press-feeds the lubricating oil reserved in the reserving chamber 2 to the engine 1 via the channel forming member 3. That is, the supply pump 4 is a pump configured to supply the lubricating oil to the engine 1. In this embodiment, the supply pump 4 is provided on the channel formed by the supply channel forming member 31. However, a configuration in which the supply pump 4 is provided integrally with the engine 1 or the reserving chamber 2 can also be employed.

The discharge pump 8 press-feeds the lubricating oil in the engine 1 to the reserving chamber 2. That is, the discharge pump 8 is a pump configured to discharge the lubricating oil in the engine 1 to the outside. In this embodiment, the discharge pump 8 is provided on the channel formed by the discharge channel forming member 32. However, a configuration in which the discharge pump 8 is provided integrally with the engine 1 or the reserving chamber 2 can also be employed.

In this embodiment, the work machine W is configured to be able to adjust the amount of the lubricating oil in the engine 1 by the reserving chamber 2, the channel forming member 3, the supply pump 4, and the discharge pump 8. That is, the engine 1 can circulate the internal lubricating oil by an oil pump, and the amount of the lubricating oil to be circulated is adjusted by the reserving chamber 2, the channel forming member 3, the supply pump 4, and the discharge pump 8.

Also, in this embodiment, the amounts of lubricating oil in the engine 1 and the reserving chamber 2 increase/decrease depending on the flow rate relationship between the supply pump 4 and the discharge pump 8. For example, if the flow rate of the supply pump 4 is larger than the flow rate of the discharge pump 8, or if the supply pump 4 is driven, and the discharge pump 8 is not driven, the amount of the lubricating oil in the reserving chamber 2 decreases, and the amount of the lubricating oil in the engine 1 increases. In addition, if the flow rate of the supply pump 4 is smaller than the flow rate of the discharge pump 8, or if the supply pump 4 is not driven, and the discharge pump 8 is driven, the amount of the lubricating oil in the reserving chamber 2 increases, and the amount of the lubricating oil in the engine 1 decreases. If the flow rates of the supply pump 4 and the discharge pump 8 equal, or if neither the supply pump 4 nor the discharge pump 8 is driven, the amounts of lubricating oil in the engine 1 and the reserving chamber 2 are maintained constant.

The work unit 9 executes a predetermined work using the engine 1 as the driving source. In this embodiment, the work unit 9 is a cutter deck. For example, the work unit 9 includes one or a plurality of blades configured to cut a lawn when rotationally driven by the engine 1 serving as the driving source, a housing that covers the blades, and a fan configured to discharge the cut lawn from the housing in a predetermined direction (none are shown). Note that the work unit 9 can appropriately be changed in accordance with a work to be executed by the work machine W.

The travel unit 10 is used by the work machine W to travel. In this embodiment, the travel unit 10 includes a pair of left and right front wheels FW and a pair of left and right rear wheels RW. For example, when the driving force of the engine 1 is transmitted to the rear wheels RW that are driving wheels, the rear wheels RW rotate, and the work machine W travels. Note that the configuration of the travel unit 10 can appropriately be changed. For example, the travel unit 10 may include a crawler belt, or the front wheels FW and the rear wheels RW need not be provided as a pair of left and right wheels.

The seat 11 is used by an operator to sit and is provided in the upper part of the work machine W. The operation unit 12 is used by the operator to operate the work unit 9 and the travel unit 10, and, in this embodiment, provided in front of the seat 11. The operation unit 12 can include, for example, a handle, a lever, a pedal, an operation button, and the like.

<Structure of Reserving Chamber>

Figure 2B:
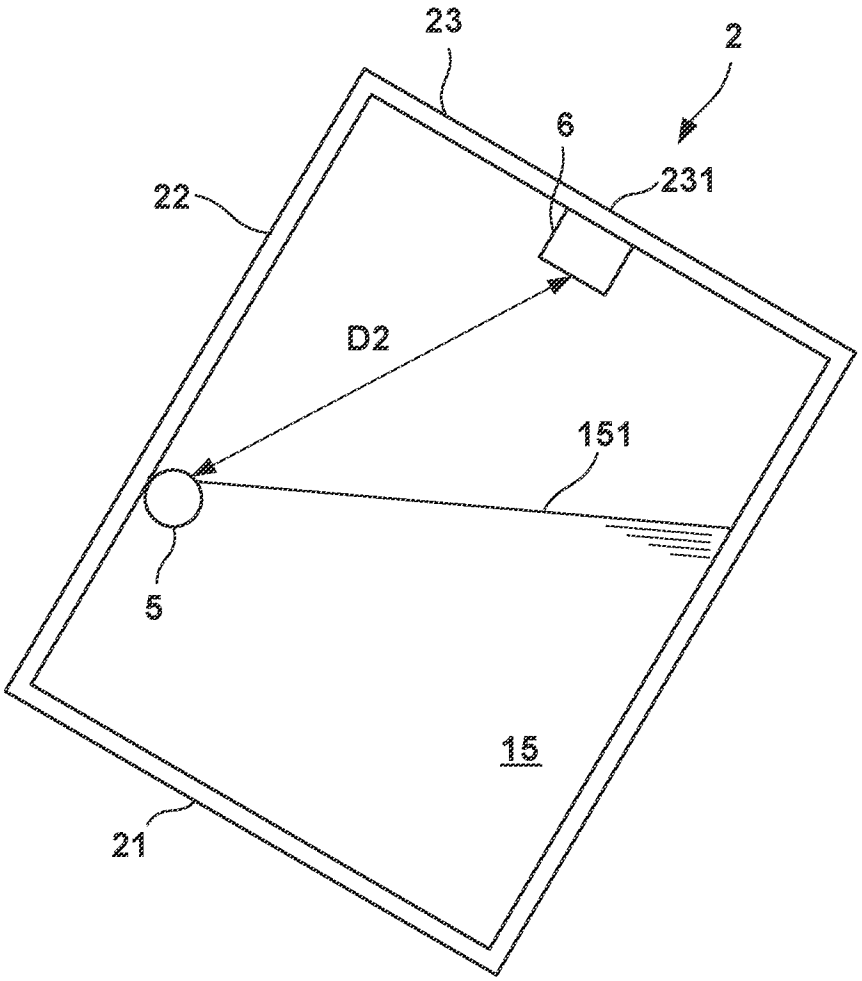
FIG. 2B is a schematic view showing an example of the internal configuration of the reserving chamber.
Figure 2A:
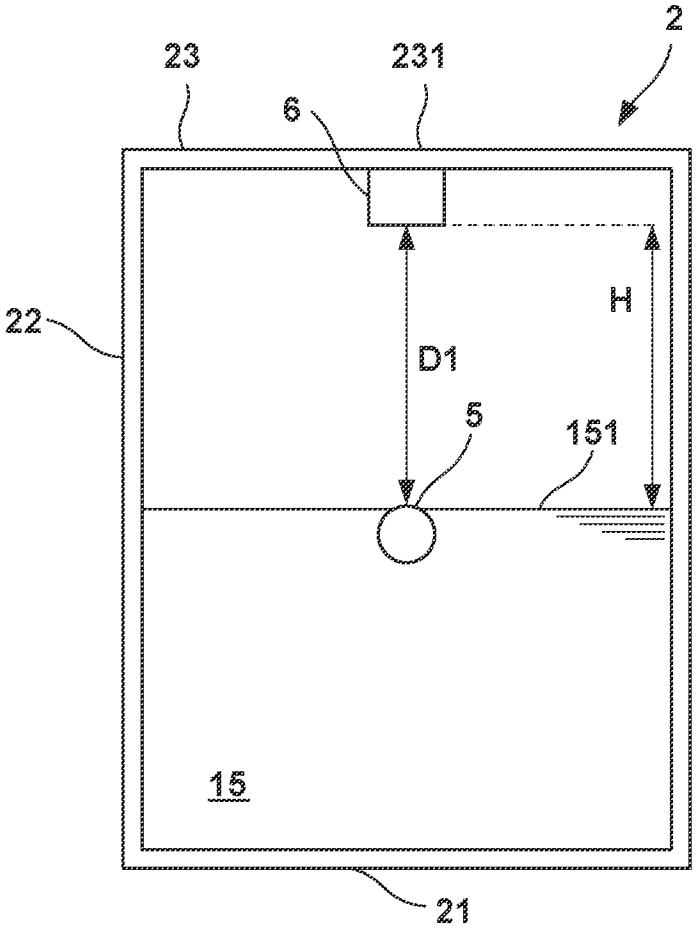
FIG. 2A is a schematic view showing an example of the internal configuration of a reserving chamber.

FIG. 2A is a schematic view showing an example of the internal configuration of the reserving chamber 2, and shows a state in which the reserving chamber 2 is level. FIG. 2B is a schematic view showing an example of the internal configuration of the reserving chamber 2, and shows a state in which the reserving chamber 2 tilts. For example, if the work machine W is placed on a flat field, the reserving chamber 2 is in the state shown in FIG. 2A. If the work machine W is traveling on a tilting field, the reserving chamber 2 is in the state shown in FIG. 2B.

The reserving chamber 2 includes a bottom wall portion 21 that forms a bottom surface, a side wall portion 22 that forms a side surface, and an upper wall portion 23 that forms an upper surface, and these define the storage space of lubricating oil 15. Note that the shapes of the wall portions can appropriately be designed. Also, the reserving chamber 2 is provided with a float 5 and a detection unit 6.

The float 5 floats on an oil surface 151 of the lubricating oil 15 reserved in the reserving chamber 2. In this embodiment, one float 5 is provided in the reserving chamber 2. However, a configuration including a plurality of floats 5, as in the second and third embodiments to be described later, can also be employed. The float 5 can appropriately be formed by a member or a structure that floats on the oil surface 151. For example, the float 5 may be a hollow spherical body. The float 5 may contain a metal. If the float 5 contains a metal with a high reflectance, the detection unit 6 can readily detect the float 5.

The detection unit 6 is provided in the reserving chamber 2 and detects the float 5. In this embodiment, the detection unit 6 is an optical sensor including a light projecting portion and a light receiving portion (neither are shown). Light projected by the light projecting portion and reflected by the float 5 is received by the light receiving portion, thereby detecting the float 5. In addition, the distance between the detection unit 6 and the float 5 can be acquired based on the light receiving amount of the reflected light received by the light receiving portion of the detection unit 6. That is, the detection result of the detection unit 6 can include information about the distance between the float 5 and the detection unit 6. Also, in this embodiment, the detection unit 6 is provided in a central portion 231 of the upper wall portion 23. For example, the central portion 231 may be a portion of the upper wall portion 23 at the center in the front-and-rear direction and at the center in the widthwise direction. Note that the detection unit 6 need not always be an optical sensor, and an ultrasonic sensor or another known technique can be applied.

The detection result of the detection unit 6 in a case in which the reserving chamber 2 tilts from the level state will be described next. Note that in the following description, the distance between the float 5 and the detection unit 6 based on the detection result of the detection unit 6 will sometimes be referred to as a detection distance.

In the state in which the reserving chamber 2 is level (FIG. 2A), a detection distance D1 is minimized when the float 5 is located immediately under the detection unit 6, and maximized when the float 5 is located in contact with the side wall portion 22. In the example shown in FIG. 2A, the float 5 is located immediately under the detection unit 6.

When the reserving chamber 2 tilts from the level state (FIG. 2B), the oil surface 151 may tilt due to the influence of an acceleration when tilting, the viscosity of the lubricating oil 15, and the like. In the example shown in FIG. 2B, the oil surface 151 tilts such that the left side on the drawing becomes higher than the right side. In this case, the float 5 moves to the left side of the drawing, which is the upper side in the gravity direction, due to buoyancy. Hence, a detection distance D2 in this case is longer than the detection distance D1. That is, the detection unit 6 detects the float 5 at a predetermined period, and if the detection distance as the result increases, it can be determined that the reserving chamber 2 tilts.

<Control Configuration>

Figure 3:
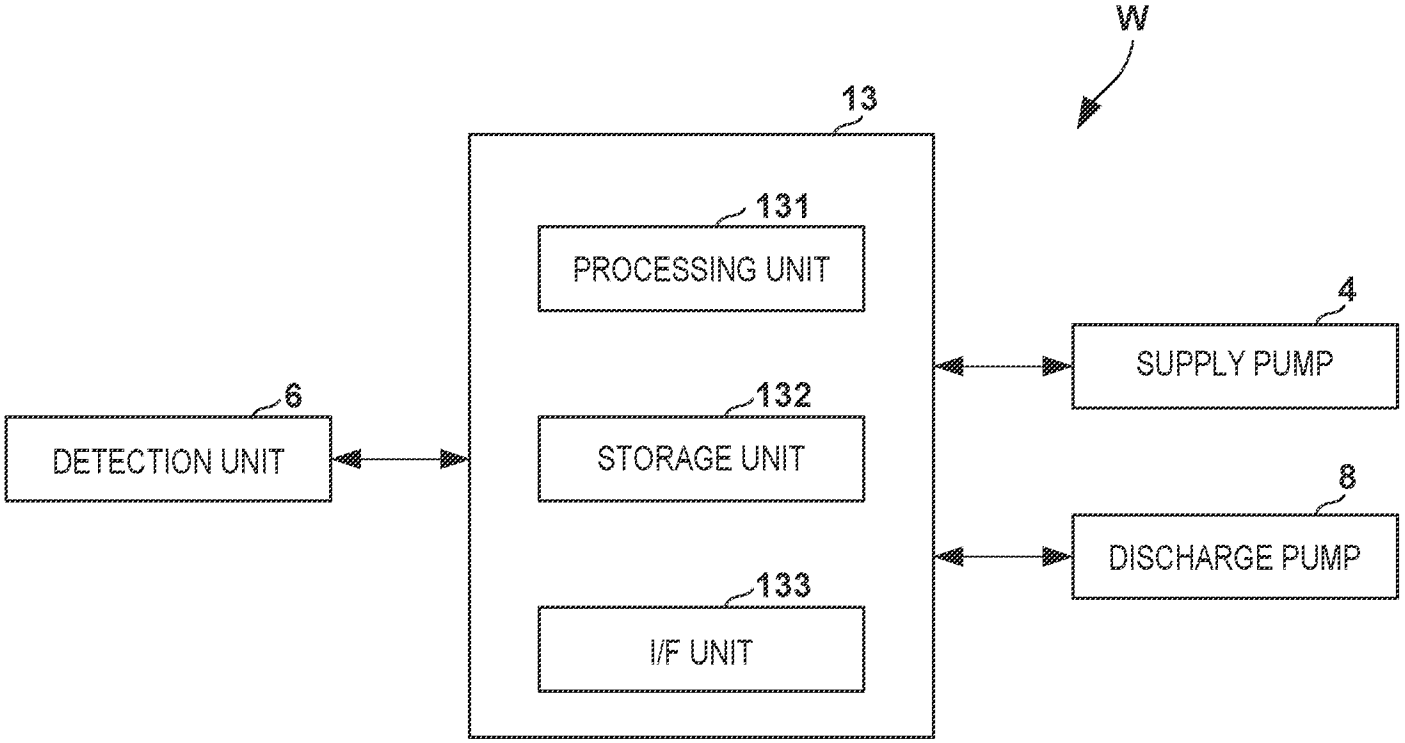
FIG. 3 is a block diagram showing an example of the configuration of hardware of the work machine.

FIG. 3 is a block diagram showing an example of the configuration of hardware of the work machine W, and mainly shows a configuration associated with <Processing Examples> to be described later. The control unit 13 includes a processing unit 131, a storage unit 132 such as a RAM or a ROM, and an interface unit 133 (I/F unit 133) that relays transmission/reception of signals between an external device and the processing unit 131. The processing unit 131 is a processor represented by a CPU, and executes a program stored in the storage unit 132. The storage unit 132 stores various kinds of data in addition to the program executed by the processing unit 131. The I/F unit 133 is constituted by, for example, a communication interface, an input/output interface, and the like. For example, detection results of the detection unit 6 and various kinds of sensors (not shown) are input to the I/F unit 133 via a signal processing circuit (not shown).

Note that the function of the control unit 13 can be implemented by both hardware and software. For example, the function of the control unit 13 may be implemented by executing a predetermined program by the CPU (Central Processing Unit) using a memory, as described above. Alternatively, the function of the control unit 13 may be implemented by a known semiconductor device such as a PLD (Programmable Logic Device) or an ASIC (Application Specific Integrated Circuit). Here, the control unit 13 is shown as a single element. However, the control unit 13 may be divided into two or more elements, as needed.

In this embodiment, the processing unit 131 controls driving of the supply pump 4 and the discharge pump 8 based on the detection result of the detection unit 6. The storage unit 132 stores the detection result of the detection unit 6. In the embodiment, the storage unit 132 stores the detection result of the detection unit 6 at a predetermined period. Note that the detection result of the detection unit 6 stored in the storage unit 132 may be a physical amount such as the light receiving amount of the light receiving portion, or may be a detection distance acquired based on the light receiving amount.

<Processing Examples>

Figure 4:
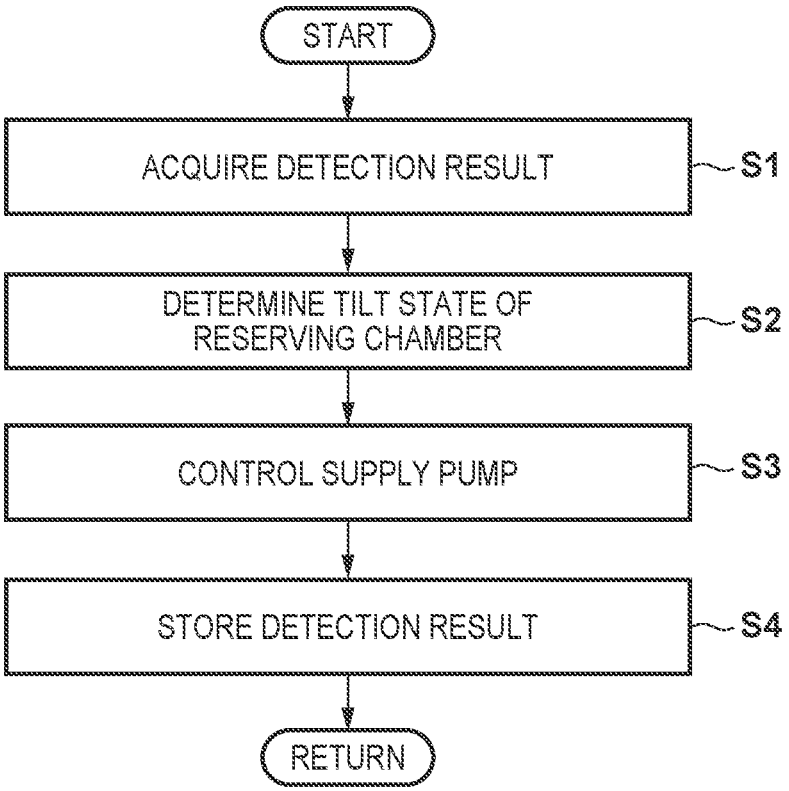
FIG. 4 is a flowchart showing an example of processing of a processing unit.

FIG. 4 is a flowchart showing an example of processing of the processing unit 131. In this embodiment, in a state in which the work machine W is tilts, the engine 1 similarly tilts. At this time, the oil surface of the lubricating oil in the engine 1 also tilts with respect to the engine 1. If the oil surface in the engine 1 tilts, the height of the oil surface on the lower side is lower than the height of the oil surface in the level state. If the height of the oil surface is not sufficient, the oil pump in the engine 1 cannot sufficiently suck/discharge the lubricating oil, and the lubricity in the engine 1 may lower. Also, since the lubricating oil in the engine 1 also has a function of cooling the constituent components of the engine 1, the cooling performance of the engine 1 may also lower. Hence, in this embodiment, the processing unit 131 performs the following processing, thereby appropriately maintaining the amount of the lubricating oil in the engine 1.

As the outline of the flowchart of FIG. 4, if the reserving chamber 2 tilts, the amount of the lubricating oil in the engine 1 is increased, thereby maintaining the lubricity in the engine 1. This flowchart is implemented when, for example, the processing unit 131 reads out a program stored in the storage unit 132 and executes it. Also, for example, this flowchart is executed repetitively at a predetermined period during driving of the engine 1. Note that a case in which the supply pump 4 and the discharge pump 8 are stopped in the initial state will be described below as an example.

In step S1 (to be simply referred to as S1 hereinafter, and this also applies to other steps), the processing unit 131 acquires the detection result of the detection unit 6. For example, the processing unit 131 acquires the detection result of the detection unit 6 via the I/F unit 133.

In S2, the processing unit 131 determines the tilt state of the reserving chamber 2 based on the detection result of the detection unit 6. In S3, the processing unit 131 controls the supply pump 4 based on the determination result in S2. Details of these processes will be described later In S4, the processing unit 131 stores the detection result of the detection unit 6 in the storage unit 132 and ends the flowchart. Note that this step may be executed when the processing unit 131 acquires the detection result of the detection unit 6 in S1.

Figure 5A:
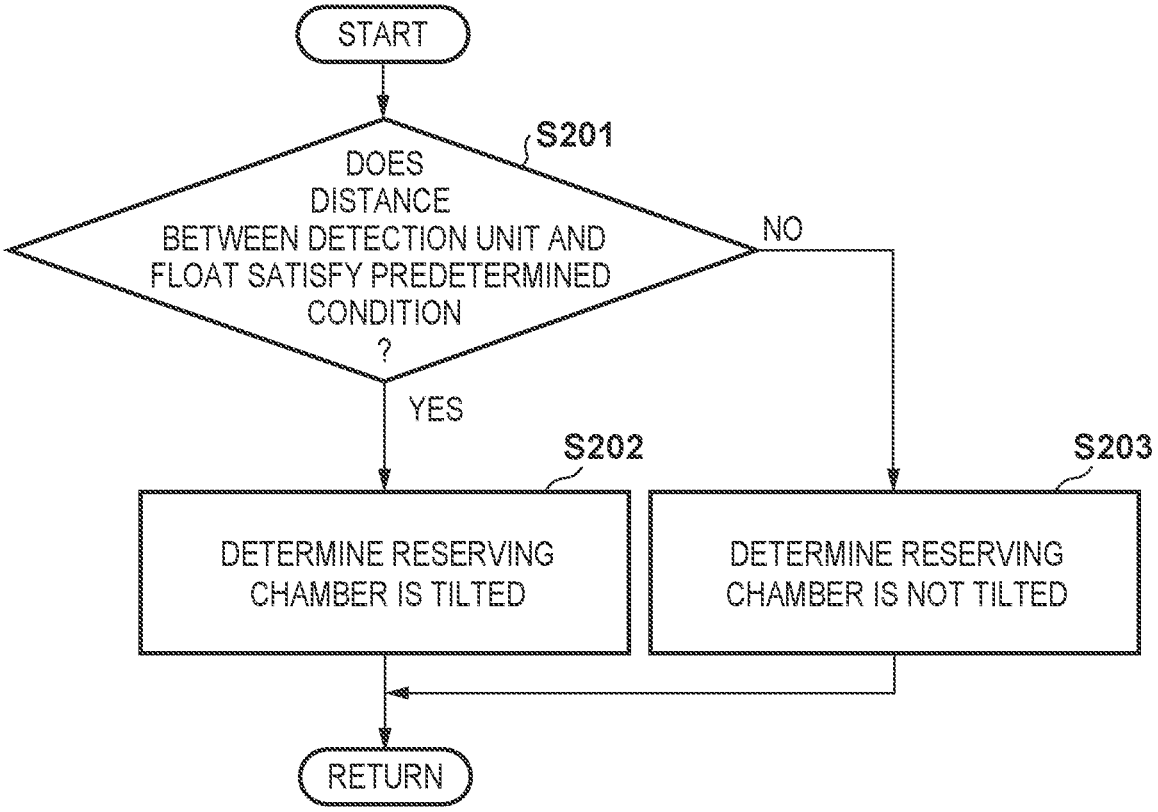
FIG. 5A is a flowchart showing an example of processing of the processing unit.

FIG. 5A is a flowchart showing an example of processing of the processing unit 131, and shows a detailed example of S2 in FIG. 4.

In S201, the processing unit 131 confirms, based on the detection result of the detection unit 6, whether the distance (detection distance) between the detection unit 6 and the float 5 satisfies a predetermined condition. If the detection distance satisfies the predetermined condition, the processing unit 131 advances to S202 and determines that the reserving chamber 2 tilts. If the detection distance does not satisfy the predetermined condition, the processing unit 131 advances to S203 and determines that the reserving chamber does not tilt. After S202 or S203, the processing unit 131 returns to the flowchart of FIG. 4.

The predetermined condition concerning the distance between the detection unit 6 and the float 5 in S201 may be a condition by comparison between the detection distance based on the current detection result of the detection unit 6 acquired in S1 and a detection distance based on a previous detection result of the detection unit 6 stored in the storage unit 132.

For example, if the detection distance based on the current detection result is larger than the detection distance based on the previous detection result, the processing unit 131 may determine that the predetermined period is satisfied, and the reserving chamber 2 tilts. More specifically, if the reserving chamber 2 is in the state shown in FIG. 2A in the previous detection by the detection unit 6, and the reserving chamber 2 is in the state shown in FIG. 2B in the current detection by the detection unit 6, a current detection distance D2 is larger than the previous detection distance D1, and therefore, the processing unit 131 may determine that the predetermined condition is satisfied.

In addition, for example, if the change amount of the detection distance based on the current detection result with respect to the detection distance based on the previous detection result is equal to or larger than a threshold, the processing unit 131 may determine that the predetermined condition is satisfied, and the reserving chamber 2 tilts. Furthermore, if the increase amount of the detection distance is equal to or larger than a threshold, the processing unit 131 may determine that the predetermined condition is satisfied. The threshold may be set as a distance [m], or may be set as a ratio [%] of the change from the previous detection distance. For example, if the current detection distance increases by 5% to 30% or more with respect to the previous detection distance, the processing unit 131 may determine that the predetermined condition is satisfied.

Furthermore, the processing unit 131 may determine, in consideration of the amount of the lubricating oil 15 in the reserving chamber 2, whether the reserving chamber 2 tilts. A height H from the detection unit 6 to the liquid surface in the level state of the reserving chamber 2 shown in FIG. 2A can be estimated based on the initial filling amount of the lubricating oil, the area of the bottom wall portion 21, the accumulation of the supply amount of the supply pump 4 and the discharge amount of the discharge pump 8, and the like. The range of the detection distance in the level state of the reserving chamber 2 can also be estimated based on the estimation value. Hence, if the current detection distance falls outside the estimated detection distance range in the level state, the processing unit 131 may determine that the reserving chamber 2 tilts.

Figure 5B:
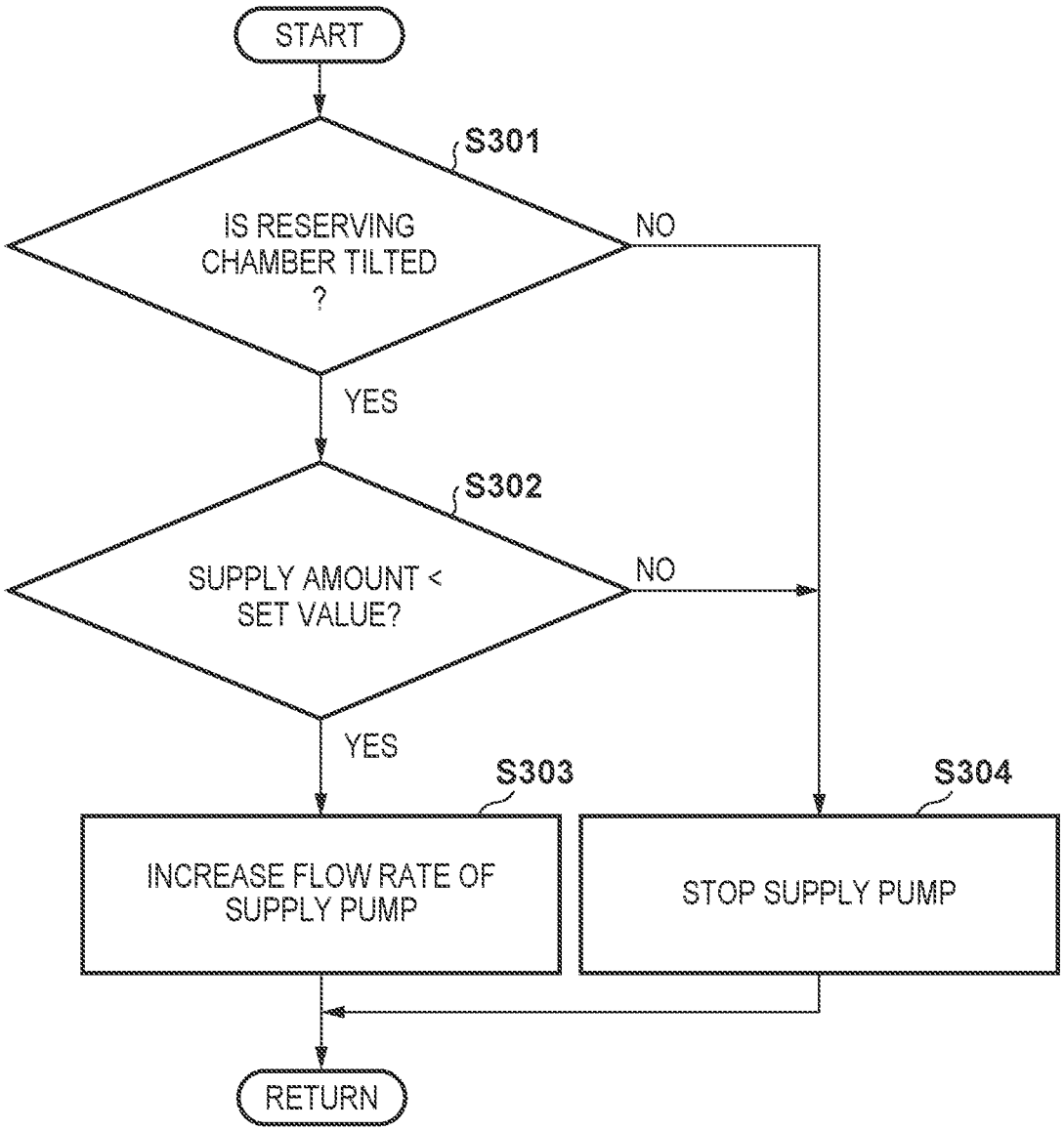
FIG. 5B is a flowchart showing an example of processing of the processing unit.

FIG. 5B is a flowchart showing an example of processing of the processing unit 131, and shows a detailed example of S3 in FIG. 4.

In S301, the processing unit 131 confirms, based on the determination result in S2, whether the reserving chamber 2 tilts. If the reserving chamber 2 tilts, the process advances to S302. If the reserving chamber 2 does not tilt, the process advances to S304.

In S302, the processing unit 131 confirms whether the supply amount of the lubricating oil from the reserving chamber 2 to the engine 1 has reached a set value. If the supply amount has reached the set value, the process advances to S304. If the supply amount has not reached the set value, the process advances to S303. The set value is set to such an amount of lubricating oil that maintains the lubricity in the engine 1 even in the tilt state when supplied to the engine 1. For example, the set value is set to such a value that makes the height of the tilting oil surface on the lower side in the engine 1 equal to or more than the height of the oil surface in the level state. Based on the control result of the supply pump 4 in the previous processing cycle, the processing unit 131 confirms whether the supply amount of the lubricating oil to the engine 1 has reached the set value.

In S303, the processing unit 131 increases the flow rate of the supply pump 4 and returns to the flowchart of FIG. 4. That is, the processing unit 131 controls the supply pump 4 such that the flow rate of the lubricating oil to be press-fed to the engine 1 increases. Note that if the flow rate of the supply pump 4 was already increased in the previous processing cycle, the processing unit 131 may maintain the pump flow rate. In this example, since the supply pump 4 is stopped in the initial state, the flow rate of the supply pump 4 increases from 0 [L/min] to a predetermined flow rate.

In S304, the processing unit 131 stops the supply pump 4 and returns to the flowchart of FIG. 4. That is, upon determining that the reserving chamber 2 does not tilt (NO in S301), the processing unit 131 stops press-feed of the lubricating oil to the engine 1 by the supply pump 4. Note that if the supply pump 4 was already stopped in the previous processing cycle, the processing unit 131 may maintain the stop state.

Note that in this embodiment, the supply pump 4 and the discharge pump 8 are stopped in the initial state, thereby maintaining the amount of the lubricating oil in the reserving chamber 2 constant, in other words, the amount of the lubricating oil in the engine 1 constant. However, the amount in the reserving chamber 2 may be maintained constant by driving the supply pump 4 and the discharge pump 8 in the same flow rate in the initial state. In addition, the amount of the lubricating oil in the engine 1 may be increased by making the flow rate of the supply pump 4 larger than the flow rate of the discharge pump 8. In this case, in S302, the processing unit 131 may determine whether the increase amount of the lubricating oil in the engine 1 has reached a set value.

In addition, if the reserving chamber 2 returns from the tilt state to the level state, the processing unit 131 may control the discharge pump 8 such that the amount of the lubricating oil in the reserving chamber 2 becomes the amount before tilting.

As described above, according to this embodiment, the supply pump 4 that press-feeds the lubricating oil to the engine 1 is controlled based on the tilt of the reserving chamber 2, or when viewed from a certain aspect, the tilt of the oil surface 151 of the lubricating oil 15 with respect to the reserving chamber 2. Hence, the amount of the lubricating oil in the engine 1 mounted in the work machine W can be similarly appropriately maintained independently of the use mode of the engine, and the lubricity in the engine 1 can be maintained. More specifically, since the amount of the lubricating oil in the engine 1 is controlled by directly detecting the tilt of the oil surface 151 by the float 5 and the detection unit 6, the amount of the lubricating oil in the engine 1 can be appropriately maintained more effectively.

A general-purpose engine is sometimes employed as the engine 1 of the work machine W. In this embodiment, the tilt of the reserving chamber 2 is determined based on the detection result of the detection unit 6 without using maps stored in the storage unit 132 in advance, or the like. Hence, the amount of oil to be supplied to the engine 1 can appropriately be maintained independently of the use mode of the engine 1.

Additionally, in this embodiment, the float 5 does not include a component such as a transmitter capable of communicating with the detection unit 6, and the distance up to the float 5 is detected by the configuration on the side of the detection unit 6. Hence, the tilt of the reserving chamber 2 can be grasped by a simple configuration. Also, in this embodiment, the reserving chamber 2 is provided under the seat 11 between the front wheel FW and the rear wheel RW in the front-and-rear direction. Since the reserving chamber 2 is located near the center of turn of the work machine W, a shake of the oil surface 151 in the reserving chamber 2 caused by a turn of the work machine W can be suppressed. It is therefore possible to suppress a determination error of the tilt state of the work machine W.

Second Embodiment

The second embodiment is different from the first embodiment in that a plurality of floats 51 to 53 are provided in a reserving chamber 2. The same reference numerals as in the first embodiment denote the same parts, and a description thereof will be omitted.

Figure 6B:
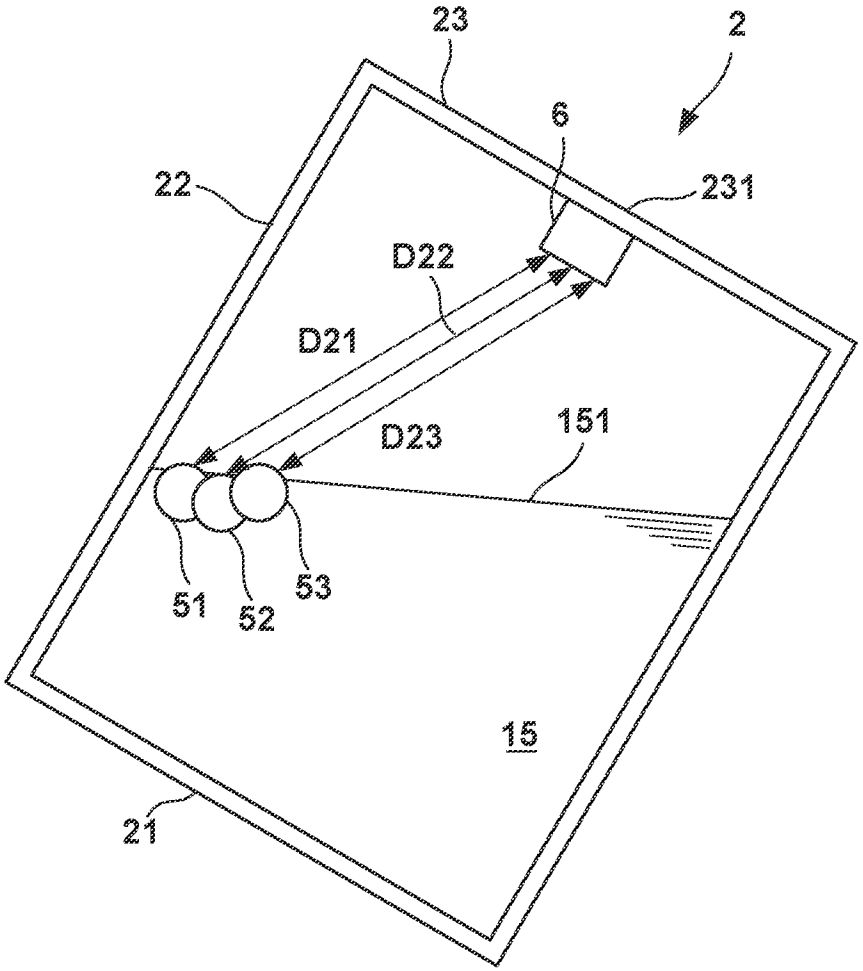
FIG. 6B is a schematic view showing an example of the internal configuration of the reserving chamber.
Figure 6A:
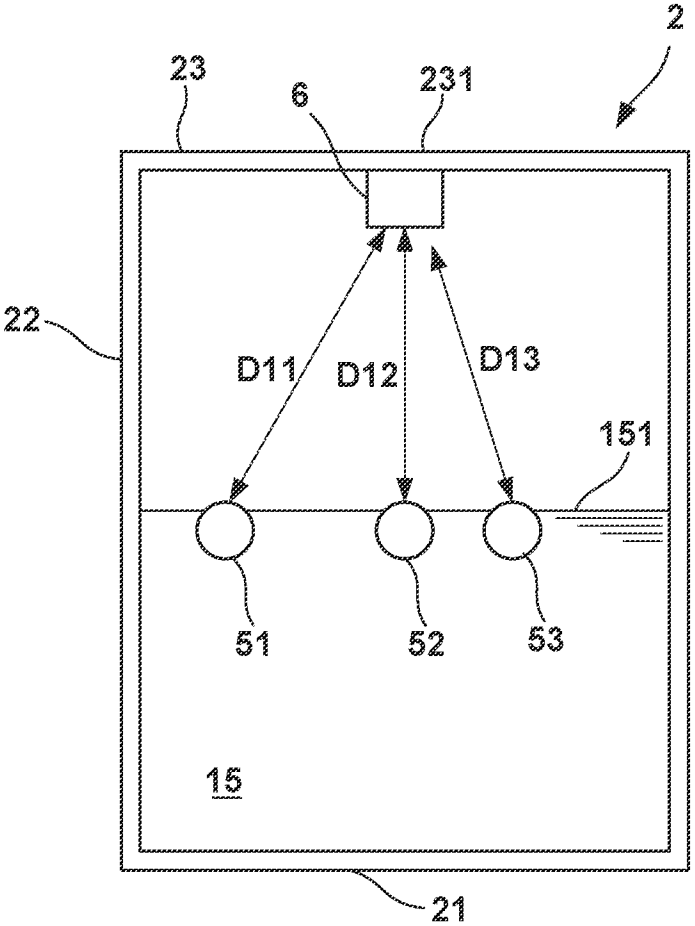
FIG. 6A is a schematic view showing an example of the internal configuration of a reserving chamber.

FIG. 6A is a schematic view showing an example of the internal configuration of the reserving chamber 2, and shows a state in which the reserving chamber 2 is level. FIG. 6B is a schematic view showing an example of the internal configuration of the reserving chamber 2, and shows a state in which the reserving chamber 2 tilts.

In this embodiment, the plurality of floats 51 to 53 are provided in the reserving chamber 2. Note that the number of floats is not limited, and may be two, or four or more. A detection unit 6 detects each of the floats 51 to 53.

Figure 7:
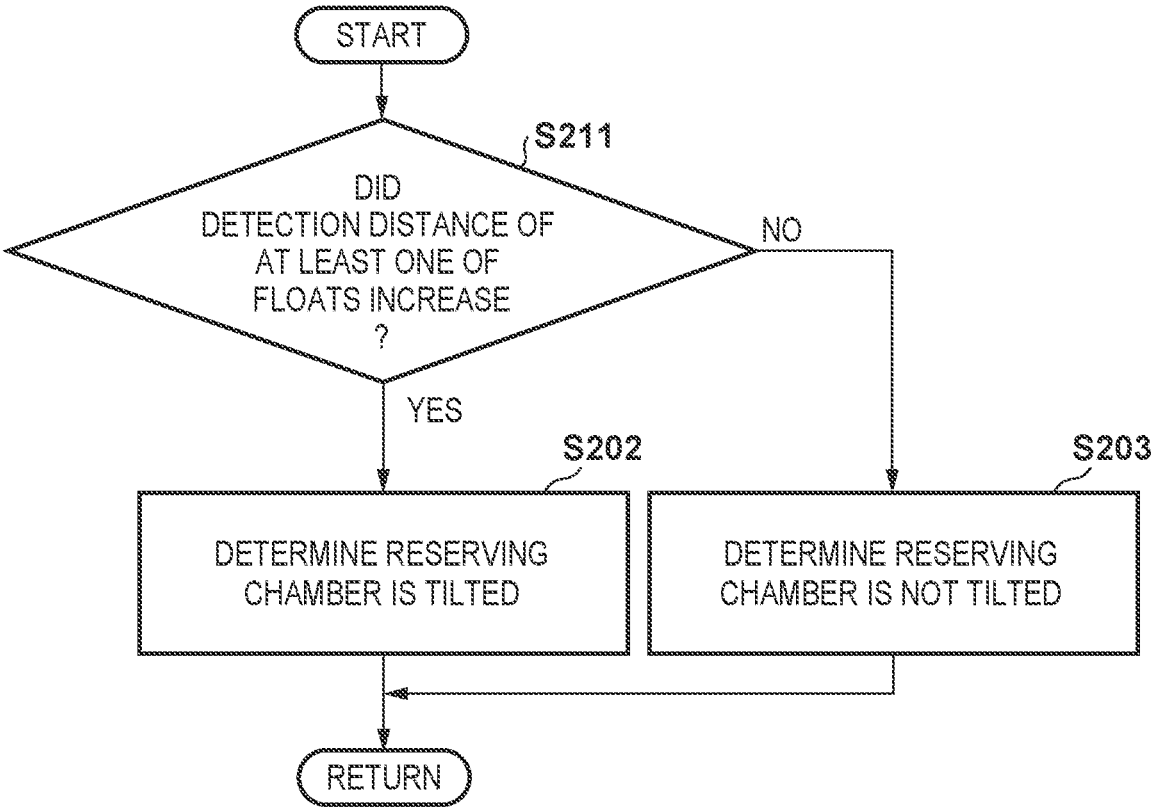
FIG. 7 is a flowchart showing an example of processing of a processing unit.

FIG. 7 is a flowchart showing an example of processing of a processing unit 131, and shows a detailed example of S2 in FIG. 4. A description will be made below using an example in which the state of the reserving chamber 2 in previous detection by the detection unit 6 is the state shown in FIG. 6A, and the state of the reserving chamber 2 in current detection by the detection unit 6 is the state shown in FIG. 6B.

In S211, the processing unit 131 confirms whether the detection distance of at least one of the plurality of floats 51 to 53 increased. If the detection distance increases, the processing unit 131 advances to S202. If the detection distance does not increase, the processing unit 131 advances to S203. S202 and S203 are the same as in the first embodiment.

For example, the processing unit 131 compares detection distances D11 and D21, detection distances D12 and D22, and detection distances D13 and D23, and if at least one of the detection distances increases, determines that the reserving chamber 2 tilts. Note that the processing unit 131 may provide a threshold for the increase amount, and determine that the reserving chamber 2 tilts if the increase amount of the distance is equal to or larger than the threshold.

If only one float is provided, in some cases, the detection distance does not change between the level state and the tilt state depending on the position of the float on the oil surface in the level state, and the processing unit 131 cannot determine the tilt of the reserving chamber 2. In this embodiment, however, since the tilt of the reserving chamber 2 is determined based on the changes of detection distances for the plurality of floats 51 to 53, the determination accuracy can be improved.

Third Embodiment

The third embodiment is different from the first and second embodiments in that one of floats provided in a reserving chamber 2 can move in the vertical direction immediately under the detection unit. The same reference numerals as in the first and second embodiments denote the same parts, and a description thereof will be omitted.

Figure 8B:
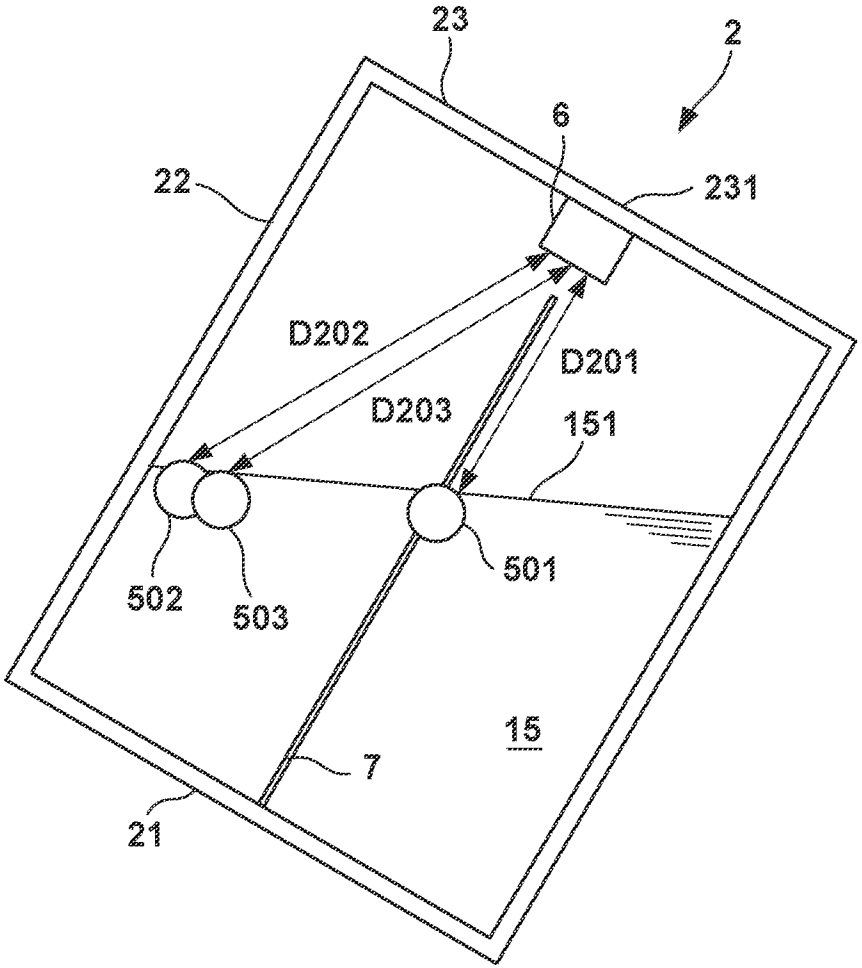
FIG. 8B is a schematic view showing an example of the internal configuration of the reserving chamber.
Figure 8A:
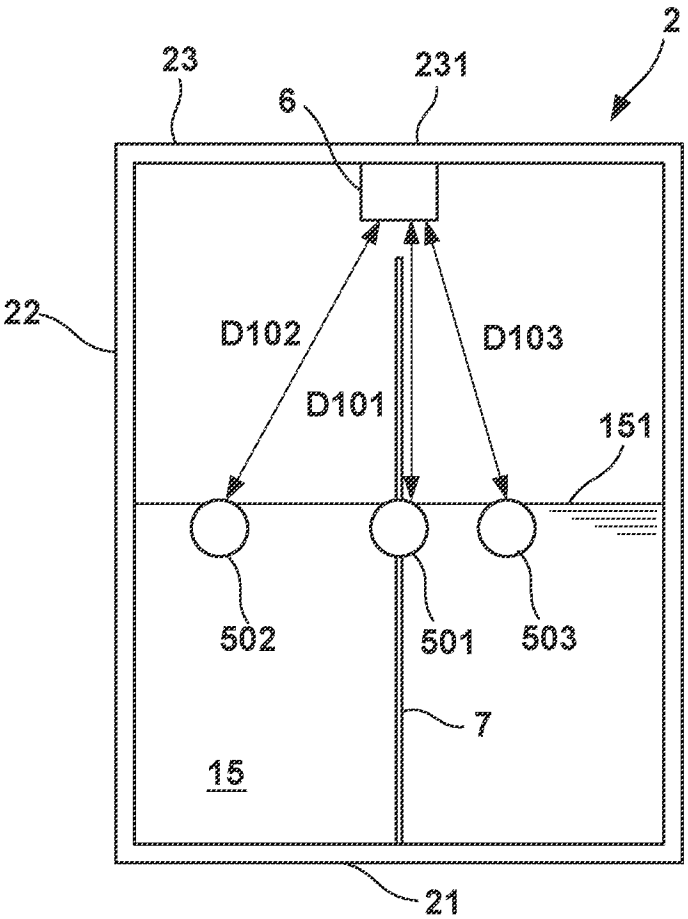
FIG. 8A is a schematic view showing an example of the internal configuration of a reserving chamber.

FIG. 8A is a schematic view showing an example of the internal configuration of the reserving chamber 2, and shows a state in which the reserving chamber 2 is level. FIG. 8B is a schematic view showing an example of the internal configuration of the reserving chamber 2, and shows a state in which the reserving chamber 2 tilts.

In this embodiment, a plurality of floats 501 to 503 are provided in the reserving chamber 2. Note that the number of floats is not limited, and may be two, or four or more. A detection unit 6 detects each of the floats 501 to 503.

Also, in this embodiment, a work machine W includes, in the reserving chamber 2, a support portion 7 that movably supports the float 501. When viewed in the level state of the reserving chamber 2, the support portion 7 supports the float 501 such that the float 501 can move in the vertical direction immediately under the detection unit 6, and its movement in the horizontal direction is regulated. For example, the support portion 7 extends through a through hole formed in the float 501, thereby making the float 501 movable in the vertical direction. By the support portion 7, in a situation in which the oil surface has no tilt in the level state, a detection distance D101 of the float 501 has the minimum value in a possible range.

Figure 9:
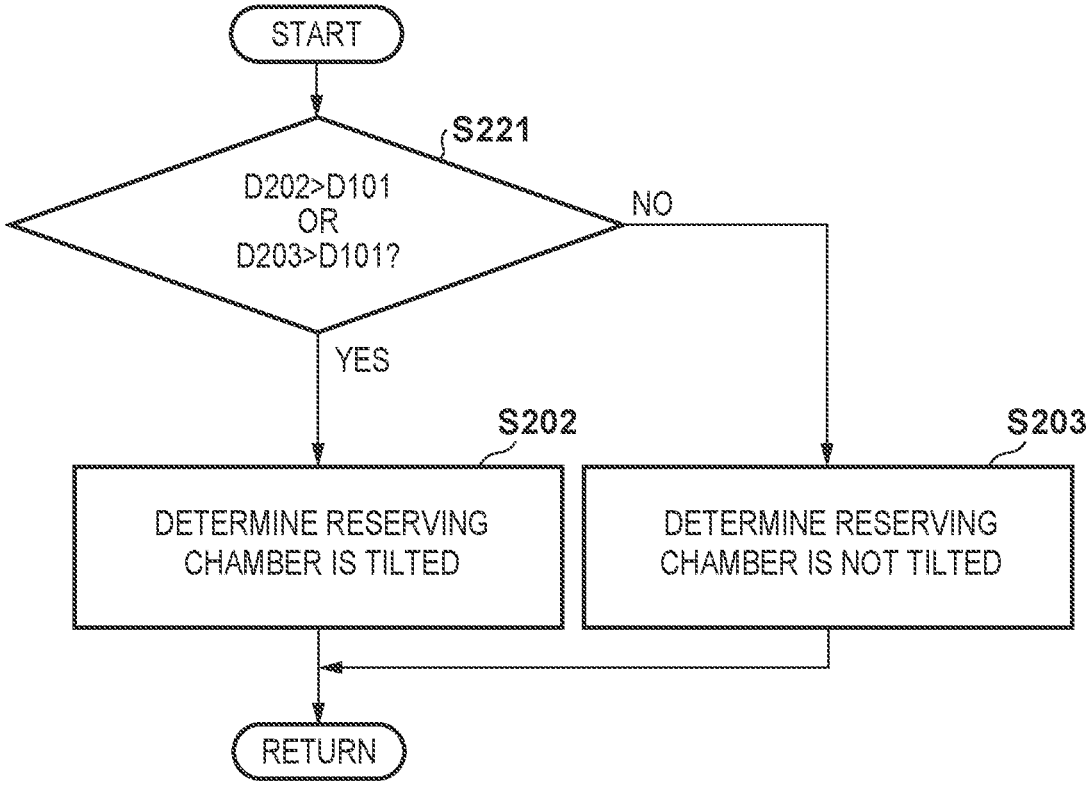
FIG. 9 is a flowchart showing an example of processing of a processing unit.

FIG. 9 is a flowchart showing an example of processing of a processing unit 131, and shows a detailed example of S2 in FIG. 4. A description will be made below using an example in which the state of the reserving chamber 2 in previous detection by the detection unit 6 is the state shown in FIG. 8A, and the state of the reserving chamber 2 in current detection by the detection unit 6 is the state shown in FIG. 8B.

In S221, the processing unit 131 confirms whether detection distance D202>detection distance D101 or detection distance D203>detection distance D101 is satisfied. If the condition is satisfied, the processing unit 131 advances to S202. If the condition is not satisfied, the processing unit 131 advances to S203. S202 and S203 are the same as in the first embodiment.

As described above, according to this embodiment, since the float 501 is supported by the support portion 7, the detection distance D101 of the float 501 in the level state and the detection distance D201 of the float 501 in the tilt state are almost equal (D101≈D201). On the other hand, in the tilt state, the floats 502 and 503 move to the upper side in the gravity direction due to the tilt of an oil surface 151. Hence, the differences between the detection distance D101 and the detection distances D202 and D203 readily become large. That is, when the detection distance D101 of the float 501 is used as a reference value, the tilt of the reserving chamber 2 can be detected more accurately based on the detection distances D202 and D203. It is therefore possible to more appropriately control the oil amount in the engine 1 based on the tilt of the reserving chamber 2.

Other Embodiments

In the above-described embodiments, the float 5 is not provided with a component capable of communicating with the detection unit 6. However, a component capable of communicating with the detection unit 6 may be provided on the side of the float 5. For example, the float 5 may include a power supply and a transmitter, and the detection unit 6 may detect the distance to the float 5 based on the reception strength, the reception time, or the like of a signal transmitted from the transmitter. This can improve the detection accuracy of the detection unit 6. In this case, a plurality of antennas may be provided in the detection unit 6, and the angle (position) of the float 5 with respect to the detection unit 6 may be detected based on the difference of the reception strength, the reception time, or the like between the antennas. The detection unit 6 may be an image capturing device such as a camera, and the tilt of the reserving chamber 2 may be detected based on an analysis result of a captured image.

Also, in the above-described embodiment, a channel capable of supplying the lubricating oil from the reserving chamber 2 to the engine 1 is formed by the channel forming member 3 separately from the circulation path of the lubricating oil in the engine 1. However, a configuration in which the reserving chamber 2 is provided on the circulation path of the lubricating oil in the engine 1 can also be employed. That is, the engine 1 may be a dry sump type engine, and the reserving chamber 2 may be an oil tank in a dry sump type engine, which is provided separately from the engine 1.

Also, in the above-described embodiment, the control unit 13 controls the supply pump 4. However, a control unit separated from the control unit 13 may be provided, and the control unit may control the supply pump 4 while communicating with the control unit 13. For example, a lubricating oil supply system for the engine 1 including the reserving chamber 2, the float 5 and the detection unit 6 in the reserving chamber 2, and the channel forming member 3, and the control unit may be constituted. The supply system may be retrofitted in the existing work machine W.

SUMMARY OF EMBODIMENTS

The above-described embodiments disclose at least a work machine, a control method thereof, and a supply system to be described below.

1. A work machine (for example, W) according to the above-described embodiment comprises:

an engine (for example, 1);

a reserving chamber (for example, 2) configured to reserve lubricating oil to be supplied to the engine;

a channel forming member (for example, 3) configured to form a channel of the lubricating oil from the reserving chamber to the engine;

a press-feed unit (for example, 4) configured to press-feed the lubricating oil reserved in the reserving chamber to the engine via the channel forming member;

a float (for example, 5) configured to float on an oil surface of the lubricating oil reserved in the reserving chamber;

a detection unit (for example, 6) provided in the reserving chamber and configured to detect the float;

a determination unit (for example, 131, S2) configured to determine a tilt state of the reserving chamber based on a detection result of the detection unit; and a control unit (for example, 131, S3) configured to control the press-feed unit based on a determination result of the determination unit.

According to this embodiment, the press-feed unit that press-feeds the lubricating oil to the engine is controlled by the tilt of the reserving chamber based on the detection result of the detection unit. It is therefore possible to appropriately maintain the amount of the lubricating oil in the engine 1 similarly mounted in the work machine W independently of the use mode of the engine.

2. According to the above-described embodiment, the detection result of the detection unit includes a distance (for example, D1, D2) between the float and the detection unit, and the determination unit determines the tilt state of the reserving chamber based on the distance (for example, S201).

According to this embodiment, the tilt of the reserving chamber can be determined by a simple configuration.

3. According to the above-described embodiment, the work machine further comprises a storage unit (for example, 132) configured to store the detection result of the detection unit at a predetermined period, wherein the determination unit determines the tilt state of the reserving chamber by comparing a current detection result of the detection unit with a previous detection result of the detection unit stored in the storage unit (for example, S201-S202).

According to this embodiment, the tilt of the reserving chamber can be determined based on the movement of the float in a case in which the reserving chamber tilts.

4. According to the above-described embodiment, if an increase amount of the distance by the current detection result of the detection unit with respect to the distance by the previous detection result of the detection unit is not less than a threshold, the determination unit determines that the reserving chamber tilts (for example, S201-S202).

According to this embodiment, the tilt of the reserving chamber can be determined more accurately.

5. According to the above-described embodiment, the float comprises a plurality of floats (for example, 51-53), and if the increase amount for at least one float of the plurality of floats is not less than the threshold, the determination unit determines that the reserving chamber tilts (for example, S211).

According to this embodiment, since the tilt of the reserving chamber is determined based on the detection results of the plurality of floats, the determination accuracy can be improved.

6. According to the above-described embodiment, the float comprises a plurality of floats (for example, 501-503), and if a result of comparison between the distance by the detection result of the detection unit for a first float included in the plurality of floats and the distance by the detection result of the detection unit for a second float that is included in the plurality of floats and is different from the first float satisfies a predetermined condition, the determination unit determines that the reserving chamber tilts (for example, S221).

According to this embodiment, since the tilt of the reserving chamber is determined based on the difference between the detection results of the different floats, the determination accuracy can be improved.

7. According to the above-described embodiment, the detection unit is provided in a central portion of an upper wall portion that forms an upper surface of the reserving chamber, and the work machine further comprises a support portion (for example, 7) configured to, when viewed in a level state of the reserving chamber, support the first float such that the first float can move in a vertical direction immediately under the detection unit, and a movement in a horizontal direction is regulated.

According to this embodiment, since the tilt of the reserving chamber is determined based on the detection results of the different floats using the detection result of the first float as a reference, the determination accuracy can be improved.

8. According to the above-described embodiment, the control unit controls the press-feed unit such that if the determination unit determines that the reserving chamber tilts, a flow rate of the lubricating oil press-fed to the engine by the press-feed unit increases (for example, S303).

According to this embodiment, since the flow rate of the lubricating oil press-fed to the engine increases in a tilt state in which the lubricity in the engine may lower, the lubricity in the engine can be maintained.

9. According to the above-described embodiment, in a case in which the press-feed unit is controlled such that the flow rate of the lubricating oil press-fed to the engine increases, if the determination unit determines that the reserving chamber does not tilt, the control unit stops press-feed of the lubricating oil to the engine by the press-feed unit (for example, S304).

According to this embodiment, it is possible to appropriately control the supply amount of the lubricating oil to the engine when the reserving chamber returns to the level state.

10. A control method of a work machine according to the above-described embodiment is a control method of a work machine (for example, W) including:

an engine (for example, 1);

a reserving chamber (for example, 2) configured to reserve lubricating oil to be supplied to the engine;

a channel forming member (for example, 3) configured to form a channel of the lubricating oil from the reserving chamber to the engine;

a press-feed unit (for example, 4) configured to press-feed the lubricating oil reserved in the reserving chamber to the engine via the channel forming member;

a float (for example, 5) configured to float on an oil surface of the lubricating oil reserved in the reserving chamber; and a detection unit (for example, 6) provided in the reserving chamber and configured to detect the float, the method comprising:

determining a tilt state of the reserving chamber based on a detection result of the detection unit (for example, S2); and controlling the press-feed unit based on a determination result in the determining (for example, S3).

According to this embodiment, it is possible to provide a control method of a work machine, which can appropriately maintain the amount of the lubricating oil to be supplied to the engine independently of the use mode of the engine.

11. A supply system according to the above-described embodiment is a supply system mountable in a work machine (for example, W) and configured to supply lubricating oil to an engine (for example, 1) of the work machine, comprising:

a reserving chamber (for example, 2) configured to reserve lubricating oil to be supplied to the engine;

a channel forming member (for example, 3) configured to form a channel of the lubricating oil from the reserving chamber to the engine;

a press-feed unit (for example, 4) configured to press-feed the lubricating oil reserved in the reserving chamber to the engine via the channel forming member;

a float (for example, 5) configured to float on an oil surface of the lubricating oil reserved in the reserving chamber;

a detection unit (for example, 6) provided in the reserving chamber and configured to detect the float;

a determination unit (for example, 132, S2) configured to determine a tilt state of the reserving chamber based on a detection result of the detection unit; and a control unit (for example, 132, S3) configured to control the press-feed unit based on a determination result of the determination unit.

According to this embodiment, a supply system capable of appropriately maintaining the amount of the lubricating oil to be supplied to the engine independently of the use mode of the engine is provided.

The invention is not limited to the foregoing embodiments, and various variations/changes are possible within the spirit of the invention.

What is claimed is:

1. A work machine comprising:

an engine;

a reserving chamber configured to reserve lubricating oil to be supplied to the engine;

a channel forming member configured to form a channel of the lubricating oil from the reserving chamber to the engine;

a press-feed unit configured to press-feed the lubricating oil reserved in the reserving chamber to the engine via the channel forming member;

a float configured to float on an oil surface of the lubricating oil reserved in the reserving chamber;

a sensor provided in the reserving chamber and configured to detect the float;

a memory storing a program;

one or more processors which, by executing the program, function as:

a determination unit configured to determine a tilt state of the reserving chamber based on a detection result of the sensor; and a control unit configured to control the press-feed unit based on a determination result of the determination unit, wherein the detection result of the sensor includes a distance between the float and the sensor, the determination unit determines the tilt state of the reserving chamber based on the distance, the work machine further comprises a storage unit configured to store the detection result of the sensor at a predetermined period, and the determination unit determines the tilt state of the reserving chamber by comparing a current detection result of the sensor with a previous detection result of the sensor stored in the storage unit.

2. The machine according to claim 1, wherein if an increase amount of the distance by the current detection result of the sensor with respect to the distance by the previous detection result of the sensor is not less than a threshold, the determination unit determines that the reserving chamber tilts.

3. The machine according to claim 2, wherein the float comprises a plurality of floats, and if the increase amount for at least one float of the plurality of floats is not less than the threshold, the determination unit determines that the reserving chamber tilts.

4. The machine according to claim 1, wherein the float comprises a plurality of floats, and if a result of comparison between the distance by the detection result of the sensor for a first float included in the plurality of floats and the distance by the detection result of the sensor for a second float that is included in the plurality of floats and is different from the first float satisfies a predetermined condition, the determination unit determines that the reserving chamber tilts.

5. The machine according to claim 4, wherein the sensor is provided in a central portion of an upper wall portion that forms an upper surface of the reserving chamber, and the work machine further comprises a support portion configured to, when viewed in a level state of the reserving chamber, support the first float such that the first float can move in a vertical direction immediately under the sensor, and a movement in a horizontal direction is regulated.

6. The machine according to claim 1, wherein the control unit controls the press-feed unit such that if the determination unit determines that the reserving chamber tilts, a flow rate of the lubricating oil press-fed to the engine by the press-feed unit increases.

7. The machine according to claim 6, wherein in a case in which the press-feed unit is controlled such that the flow rate of the lubricating oil press-fed to the engine increases, if the determination unit determines that the reserving chamber does not tilt, the control unit stops press-feed of the lubricating oil to the engine by the press-feed unit.

8. A control method of a work machine including:

an engine;

a reserving chamber configured to reserve lubricating oil to be supplied to the engine;

a channel forming member configured to form a channel of the lubricating oil from the reserving chamber to the engine;

a press-feed unit configured to press-feed the lubricating oil reserved in the reserving chamber to the engine via the channel forming member;

a float configured to float on an oil surface of the lubricating oil reserved in the reserving chamber; and a sensor provided in the reserving chamber and configured to detect the float, the method comprising:

determining a tilt state of the reserving chamber based on a detection result of the sensor; and controlling the press-feed unit based on a determination result in the determining, wherein the detection result of the sensor includes a distance between the float and the sensor, the determining determines the tilt state of the reserving chamber based on the distance, the work machine further comprises a storage unit configured to store the detection result of the sensor at a predetermined period, and the determining determines the tilt state of the reserving chamber by comparing a current detection result of the sensor with a previous detection result of the sensor stored in the storage unit.

9. A supply system mountable in a work machine and configured to supply lubricating oil to an engine of the work machine, comprising:

a reserving chamber configured to reserve lubricating oil to be supplied to the engine;

a channel forming member configured to form a channel of the lubricating oil from the reserving chamber to the engine;

a press-feed unit configured to press-feed the lubricating oil reserved in the reserving chamber to the engine via the channel forming member;

a float configured to float on an oil surface of the lubricating oil reserved in the reserving chamber;

a sensor provided in the reserving chamber and configured to detect the float;

a memory storing a program;

one or more processors which, by executing the program, function as:

a determination unit configured to determine a tilt state of the reserving chamber based on a detection result of the sensor; and a control unit configured to control the press-feed unit based on a determination result of the determination unit, wherein the detection result of the sensor includes a distance between the float and the sensor, the determination unit determines the tilt state of the reserving chamber based on the distance, the work machine further comprises a storage unit configured to store the detection result of the sensor at a predetermined period, and the determination unit determines the tilt state of the reserving chamber by comparing a current detection result of the sensor with a previous detection result of the sensor stored in the storage unit.

* * * * *